US007017588B2

(12) United States Patent
Peck et al.

(10) Patent No.: US 7,017,588 B2
(45) Date of Patent: Mar. 28, 2006

(54) HAIR STYLING DEVICE

(75) Inventors: Leslee L. Peck, 711 NW. 11th Ave., Portland, OR (US) 97209; Scott Peterson, Beaverton, OR (US)

(73) Assignee: Leslee L. Peck, Portland, OR (US)

( * ) Notice: Subject to any disclaimer, the term of this patent is extended or adjusted under 35 U.S.C. 154(b) by 184 days.

(21) Appl. No.: 10/463,079

(22) Filed: Jun. 17, 2003

(65) Prior Publication Data

US 2003/0230318 A1 Dec. 18, 2003

Related U.S. Application Data

(60) Provisional application No. 60/470,690, filed on May 14, 2003, provisional application No. 60/389,763, filed on Jun. 17, 2002.

(51) Int. Cl.
*A45D 24/00* (2006.01)

(52) U.S. Cl. ..... 132/200

(58) Field of Classification Search ..... 132/212, 132/200, 144, 151, 150, 135
See application file for complete search history.

(56) References Cited

U.S. PATENT DOCUMENTS 6,286,519 B1 * 9/2001 Stachowski ..... 132/273

* cited by examiner

*Primary Examiner*—John J. Wilson
*Assistant Examiner*—Robyn Doan
(74) *Attorney, Agent, or Firm*—Kolisch Hartwell, P.C.

(57) ABSTRACT

A hair styling device includes an elongate body having a pick end for separating strands of hair. The device includes a pair of arms pivotally attached to the elongate body. A method of styling hair using the hair styling device, the method includes separating a section of hair. The method includes dividing the section of hair into two strands of hair using a hair styling device with each strand positioned between a body of the device and an arm of the device. The method includes crossing each of the two strands over the front of the body of the hair styling device and sliding each strand under an arm opposed to the arm bounding each strand. The method includes pulling each strand up through a space between the body of the styling device and the scalp. The method includes wrapping each strand a plurality of times around a section of the opposite strand located between the body of the device and the scalp. The method includes extending each section of hair around the outside of the arm defining the bounds of the opposite section. The method includes removing the hair styling device using a downward motion causing the arms to pivot upward pulling permitting the hair wrapped around them to be released and securing the hair into a twisted knot.

1 Claim, 8 Drawing Sheets

114

114

HAIR STYLING DEVICE

CROSS-REFERENCE TO RELATED APPLICATIONS

This application claims priority to U.S. Provisional Patent Application Ser. No. 60/389,763, filed Jun. 17, 2002 and entitled "Hair Styling Device" and to U.S. Provisional Patent Application Ser. No. 60/470,690, filed May 14, 2003 and entitled "Hair Styling Device", both of which are hereby incorporated by reference.

BACKGROUND OF THE INVENTION

The present invention relates to a hair styling device and more particularly pertains to allowing a section of hair to be tied into a twisted elongated knot, that is self-secured with no pins or bands.

The use of hair styling implements is known in the prior art. More specifically, hair styling implements heretofore devised and utilized for the purpose of styling hair are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,036,870 to Edmark discloses a tool comprised of a probe and loop for inverting a hair tail. U.S. Pat. No. 5,289,834 to Lawrence discloses a tool comprised of a loop for treading a ponytail type hairstyle. U.S. Pat. No. 5,499,638 to Ripley and 5,293,884 to Chapman disclose additional hair styling accessories. While these devices fulfill their respective, particular objective and requirements, the aforementioned patents do not describe a hair styling device for allowing a section of hair to be tied into a twisted elongated knot by when pulling the ends is self secured with no pins or bands.

A hair styling device according to the present invention substantially departs from the conventional concepts and designs of the prior art, and in doing so provides an apparatus primarily developed for the purpose of allowing a section of hair to be tied into a twisted elongated knot.

Therefore, it can be appreciated that there exists a continuing need for a new and improved hair styling device which can be used for allowing a section of hair to be tied into a twisted elongated knot. In this regard, the present invention substantially fulfills this need.

SUMMARY

In the view of the foregoing disadvantages inherent in the known types of hair styling implements now present in the prior art, the present invention provides an improved hair styling device. As such, the general purpose of the present invention, which will be described subsequently in greater detail, is to provide a new and improved hair styling device which has all the advantages of the prior art and none of the disadvantages.

To attain this, the present invention essentially comprises a body which is wider at the top, tapering down to a narrow point. Attached to the body is a curved arm on either side of the body. The arms are attached to a hinge that allows the arms to release so that the hair styling device can be removed from the hair.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The invention will be better understood and objects other than those set forth above will become apparent when consideration is given to the following detailed description thereof. Such description makes reference to the drawings wherein.

DESCRIPTION OF THE PREFERRED EMBODIMENTS

With reference now to the drawings, and in particular, to FIGS. 1 through 4, an embodiment of the new and improved hair styling device embodying the principles and concepts of the present invention and generally designated by the reference number 10 will be described.

Specifically, it will be noted in the various figures that the device relates to a hair styling device for allowing a section of hair to be tied in a twisted elongated knot. In its broadest context, the device consists of a main body with two arms. Such components are individually configured and correlated with respect to each other so as to attain the desired objective.

Figure 1:
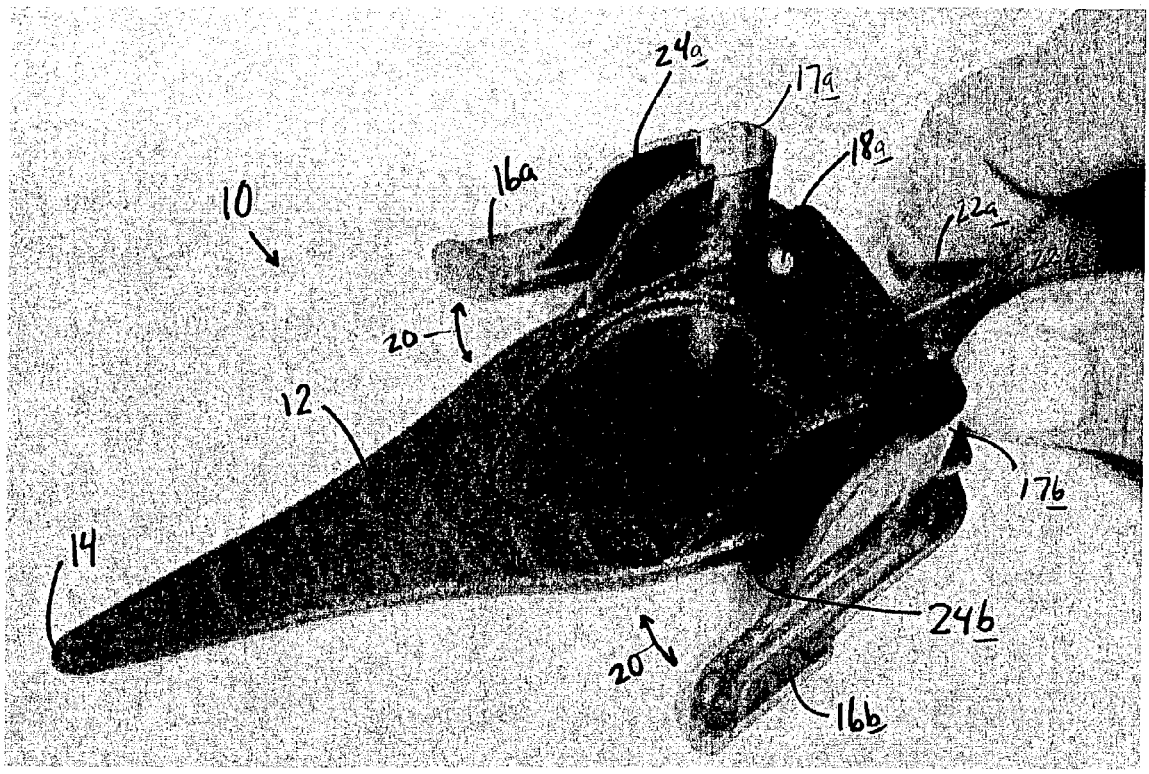
FIG. 1 is top view photo of a hair styling device constructed in accordance with the present invention.

FIG. 1 shows an embodiment of hair styling device 10 of the present invention having a main body 12 and a pick end 14 for separating strands of hair. Two arms 16*a* and 16*b* are pivotally attached to main body 12 by hinge joints or pivots 18*a* and 18*b*. Arms 16*a* and 16*b* pivot as indicated by arrows 20 and are biased into a closed or inward position near main body 12 by biasing members 17*a* and 17*b*. The rotation of arms 16*a* and 16*b* facilitates insertion and removal of the device and formation of the twisted elongate knot.

Figure 2:
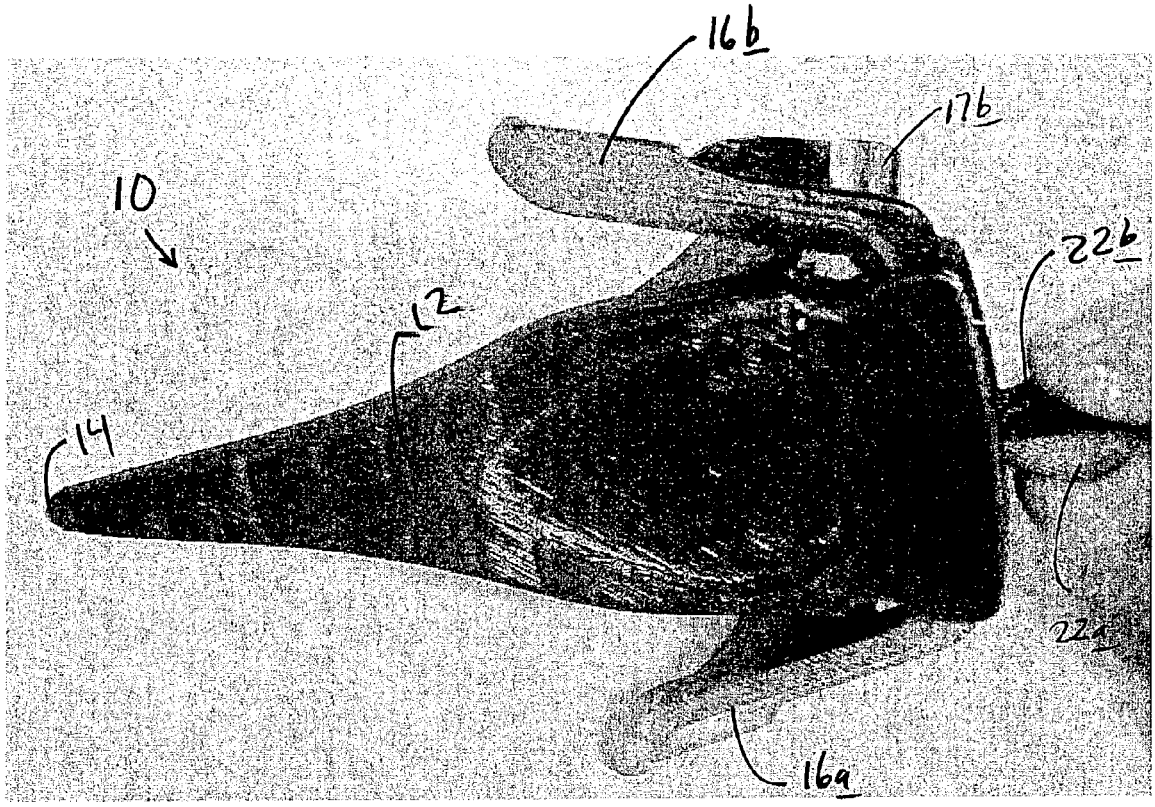
FIG. 2 is a bottom view photograph of a hair styling device constructed in accordance with the present invention.
Figure 3:
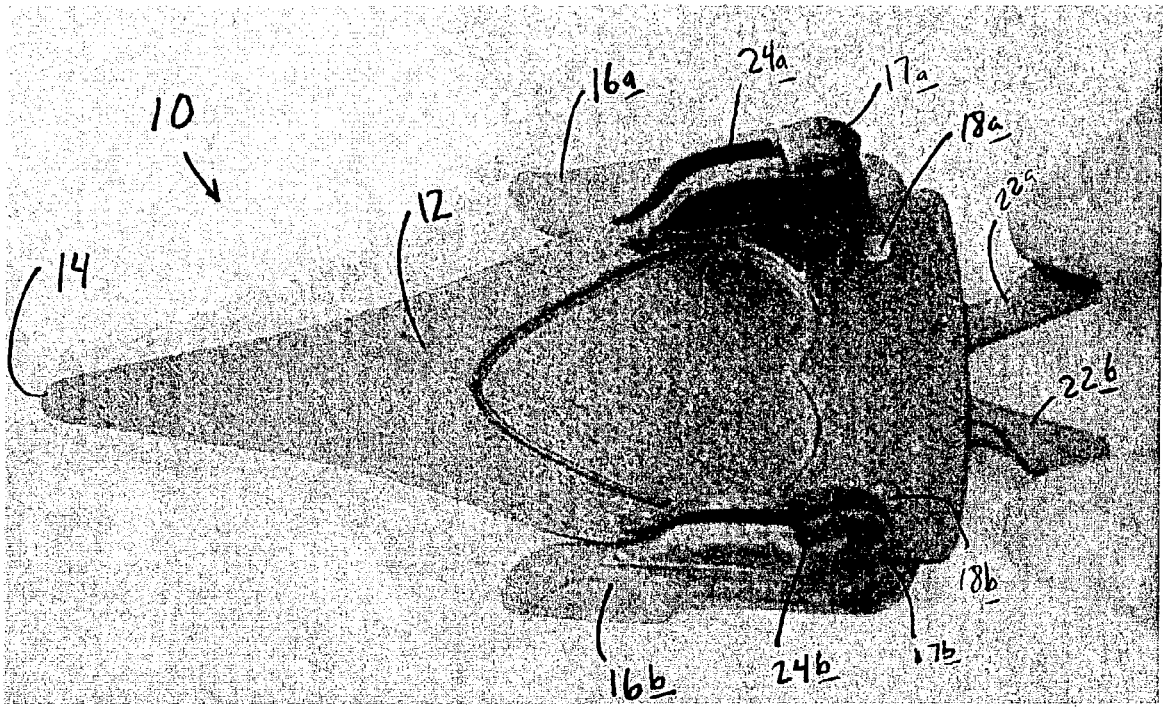
FIG. 3 is atop view photograph of a hair styling device in accordance with the present invention.

Handles 22*a* and 22*b* are used to pivot arms 16*a* and 16*b* against the bias from bias members 17*a* and 17*b*. As will be explained below, opening and closing arms 16*a* and 16*b* enables use of the hair styling device to create a twisted elongate knot. FIGS. 1 and 2 show handles 22*a* and 22*b* in the squeezed together configuration, which is used during insertion and removal of the device from a section of hair. In this squeezed together configuration arms 16*a* and 16*b* spread open away from body 12 to aid in inserting the device into a section of hair. FIG. 3 shows handles 22*a* and 22*b* in an open configuration with arms 16*a* and 16*b* biased adjacent body 12 of device 10.

Hair styling device 10 includes hair channels 24*a* and 24*b* that provide a space between strands of hair and the body 12 of device 10 to enable wrapping, as will be explained below. These channels enable the device to be used to create elongate knots with wrappings that occur on the outside of the device body as opposed to other embodiments that may require wrapping to take place between the body of device 10 and the scalp of the person whose hair is being styled.

The present invention is designed for a section of hair to be tied into a twisted-elongated knot as explained by the following steps:

1) Hold the two handles 22*a* and 22*b* at the top of the hair styling device 10, with the pointed end 14 of the hair styling device make a section of hair by parting the hair about 2 inches long (for smaller) to 3 inches long (for larger) twists and about ¼ of an inch to a ½ of an inch thick.

2) Hold the end of the section of hair with a little tension. Insert the hair styling device 10, pointed end 14 first, through the middle of the section of hair, which will divide the section into two neatly divided strands.

3) Pinch the two handles 22*a* and 22*b* at the top of the hair styling device 10 together to release the arms away from the body of the device.

4) Slide the hair styling device 10 down to the scalp so that the two divided strands of hair are under the arms 16*a* and 16*b* of the device 10. Let go of the two handles 22*a* and 22*b* at top of device 10 so that the arms clamp down on the two divided strands of hair, because of biasing members 17*a* and 17*b*. The separated strands of hair extend outward from body 12 because of hair channels 24*a* and 24*b*.

5) Take one of the two divided strands of hair and cross one strand over the other strand and pull the end through the opening formed between the crossed strands of hair and the body 12 of device 10 and wrap the crossed strand 4 times around the other strand.

6) Hold the two ends of the wrapped hair together, pinch the two handles 22*a* and 22*b* on top of the device together to release the grip of the arms 16*a* and 16*b*.

7) Pull the hair styling device 10 up and out of the wrapped hair and pull the two ends of the strands of hair in opposite directions to secure the twisted knot to the head.

8) Repeat steps 1–7 to tie more elongate twisted knots into the hair on a persons head.

Figure 4:
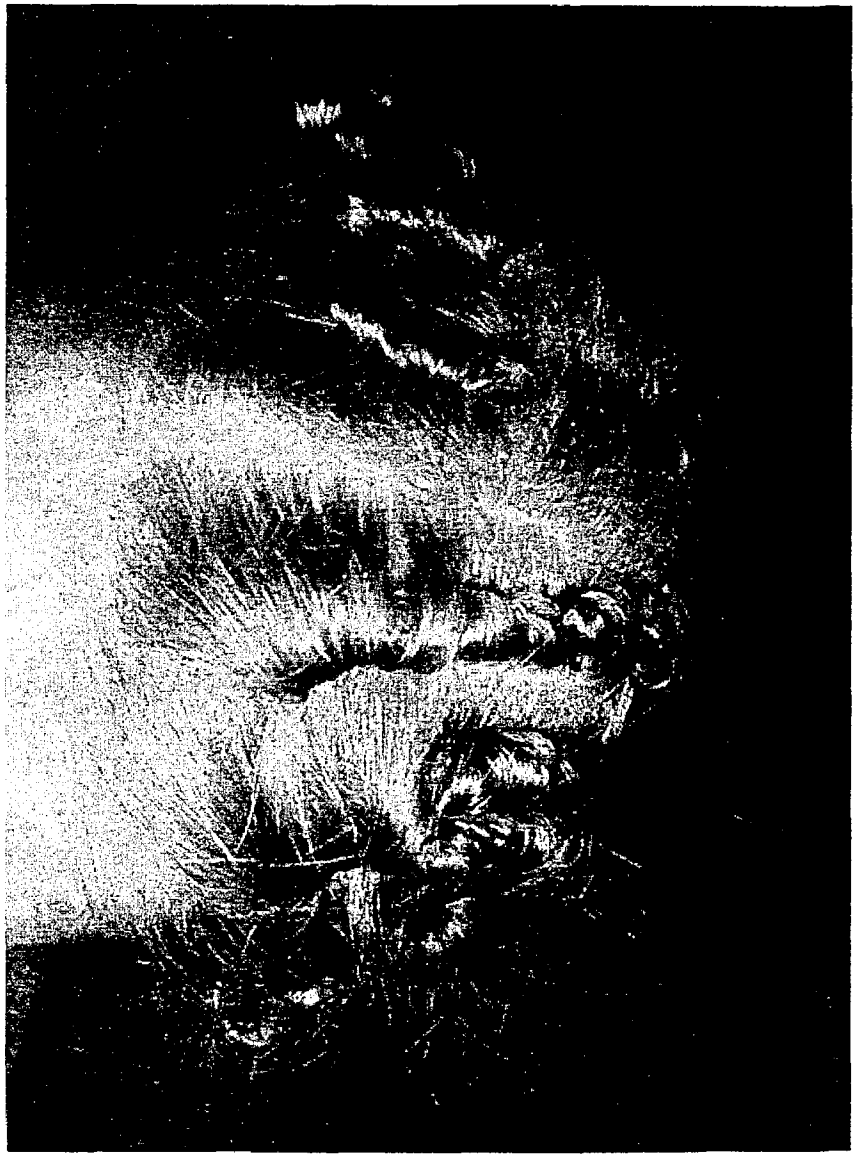
FIG. 4 is a photograph of hair styled using the device of FIG. 1.

FIG. 4 illustrates what the hairstyle that results after several of the knots have been tied. IT will be understood that the hairstyle illustrated in FIG. 4 may be achieved using any of the embodiments of the present invention described herein.

Figure 5:
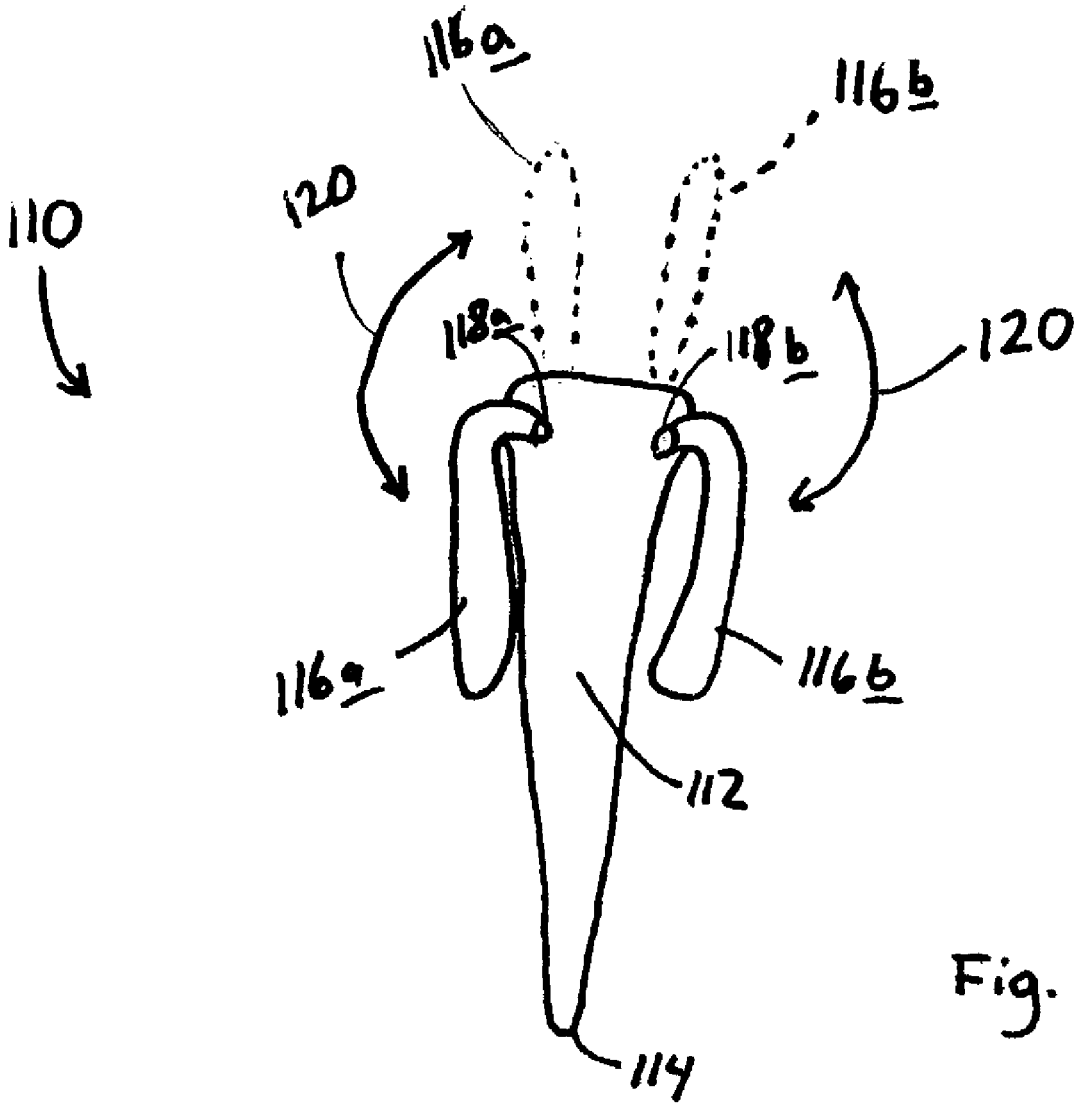
FIG. 5 is a photograph of a hair styling device of FIG. 1, with hinged arms rotated upward for removal of the device from a person's hair.

Another embodiment of the present invention is shown in FIGS. 5–10. This embodiment achieves a similar twisted hairstyle using a slightly different technique. FIG. 5 shows an embodiment of a hair styling device 110 of the present invention having a main body 112 and a pick end 114 for separating strands of hair. Two arms 116*a* and 116*b* are pivotally attached to main body 112 by a hinge joint or pivot 118. Arms 116*a* and 116*b* pivot as indicated by arrows 120. The rotation of arms 116*a* and 116*b* facilitates removal of the device and formation of the twisted elongate knot.

Figure 6:
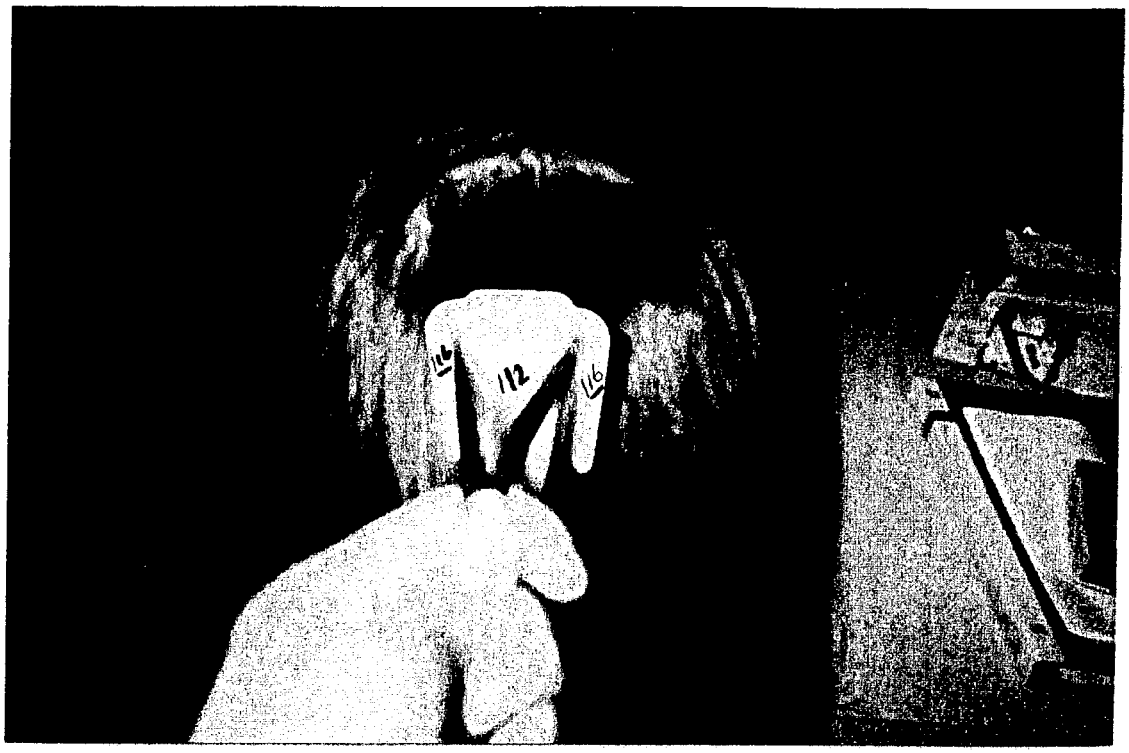
FIG. 6 is a photograph of a hair styling device of FIG. 1, being used to style a persons hair, showing the initial step of threading strands of hair between the body of the device and the arms of the device.
Figure 7:
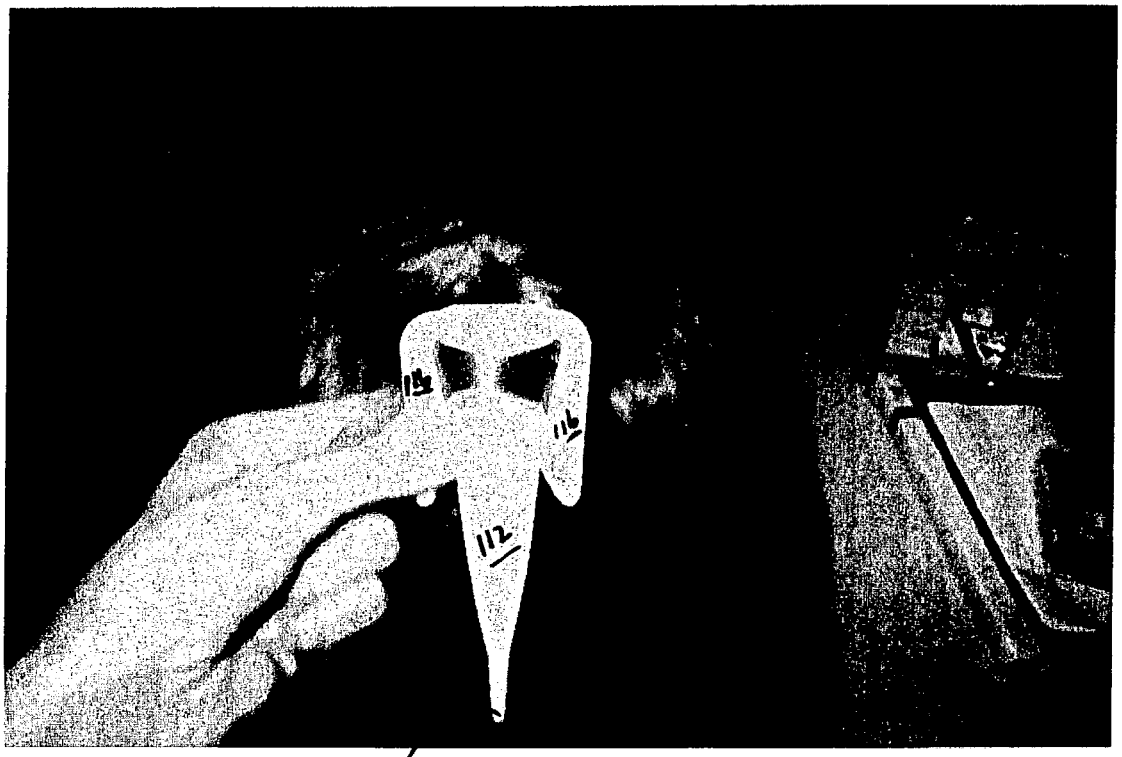
FIG. 7 is a photograph of a hair styling device of FIG. 1, being used to style a persons hair, showing the step of threading strands of hair around the body of the device and between the body of the device and the opposite arms.
Figure 8:
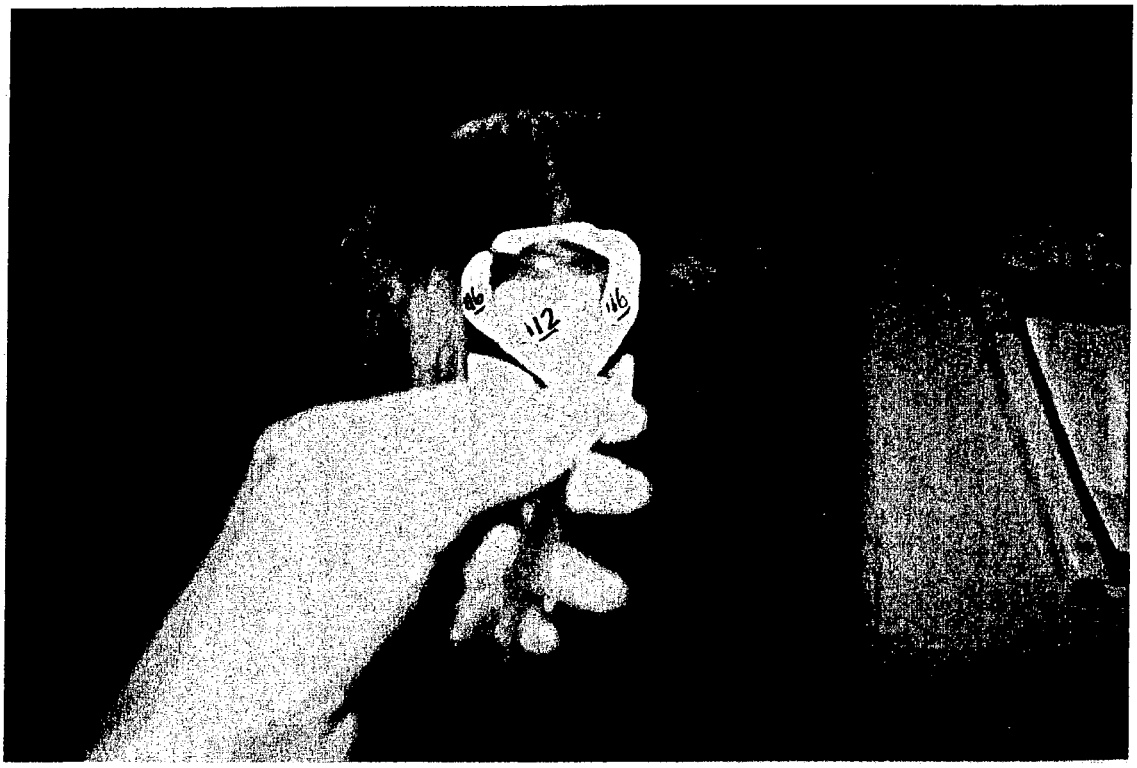
FIG. 8 is a photograph of a hair styling device of FIG. 1, being used to style a persons hair, showing the step of threading strands of hair around the outside of the arms of the device.
Figure 9:
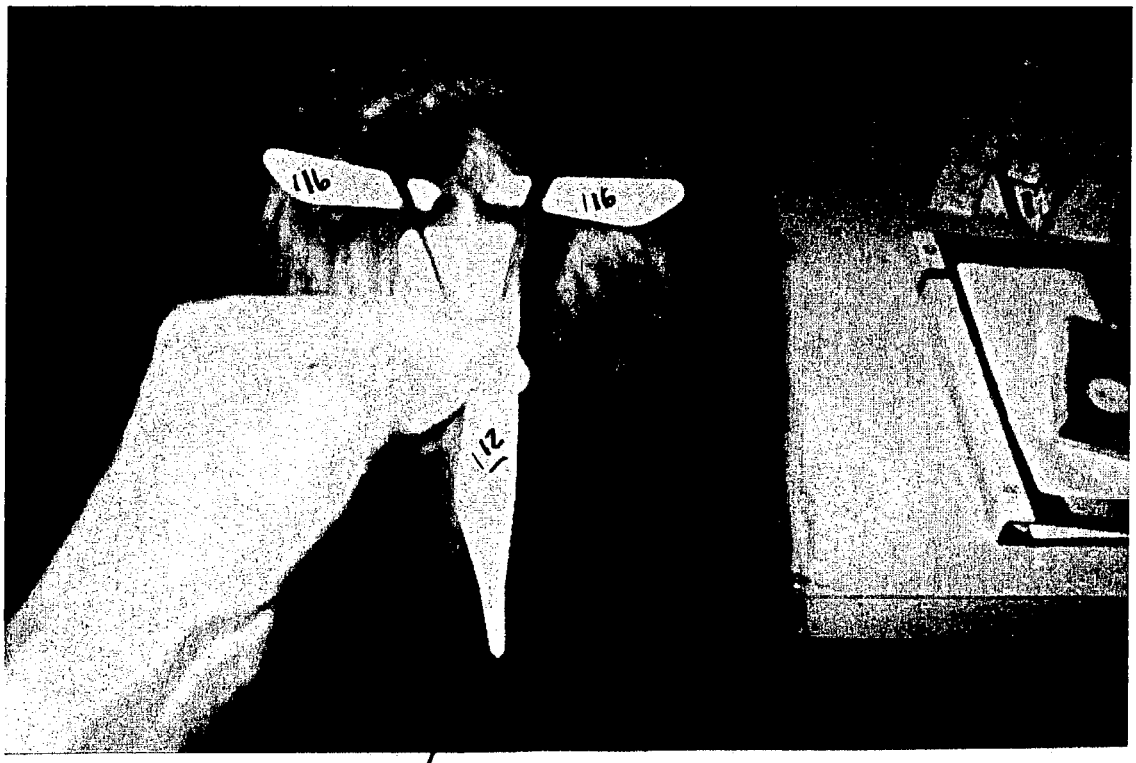
FIG. 9 is a photograph of a hair styling device of FIG. 1, being used to style a persons hair, showing the step of lifting the arms for removal of the device.
Figure 10:
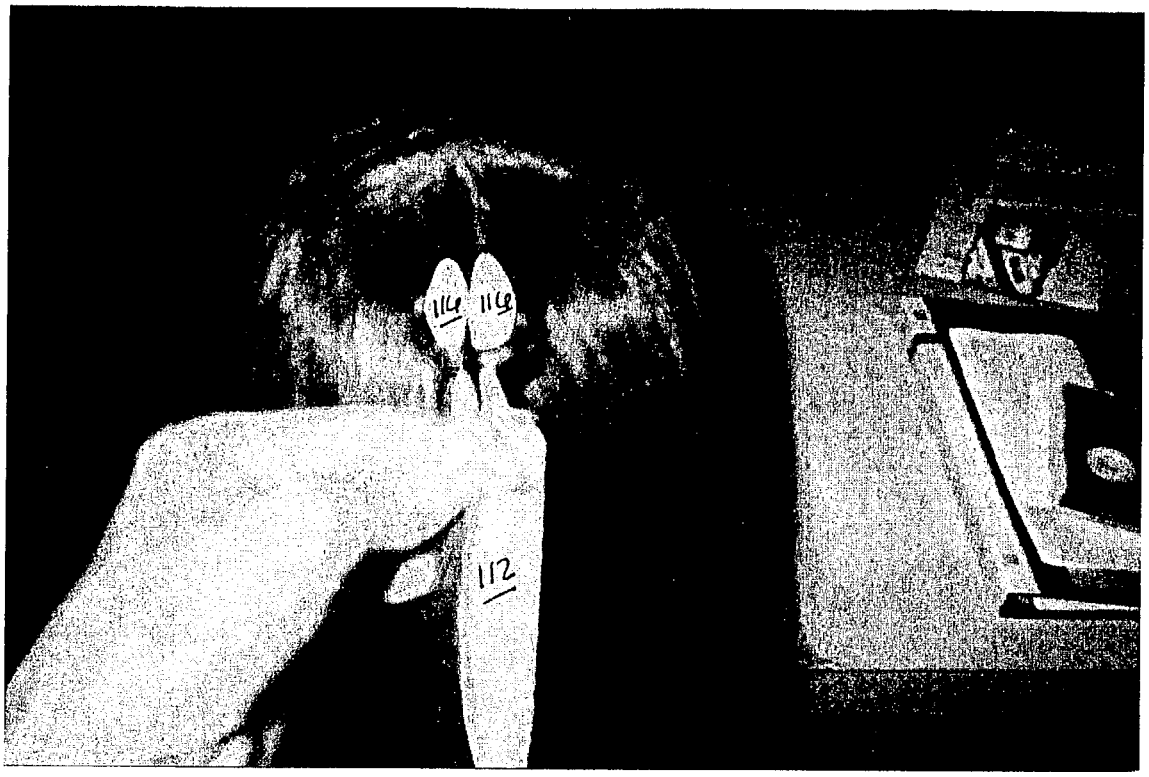
FIG. 10 is a photograph of a hair styling device of FIG. 1, being used to style a persons hair, showing the step of removal of the device.

The present invention is designed for a section of hair to be tied into a twisted elongated knot as explained in conjunction with FIGS. 6–10. As shown in FIG. 6, device 110 is initially inserted through a section of hair separating the section of hair into two smaller strands or sections and leaving a space between the back of the body of the device and the scalp for hair to pass through. As shown in FIG. 7, the divided strand of hair under each arm of the hair styling device, are crossed over the front body 112 of hair styling device 110 and under the opposite arm. The end of the strand is then pulled up through the open space provided between the scalp of the person whose hair is being styled and the body of the device and wrapped twice around the section of the strand of hair extending between the device and the scalp. The same process is repeated with the other strand of hair. The two ends of the strands of wrapped hair are then extended around the outside of arms 116 and held in front of the body of the hair styling device to secure while pulling the hair styling device from the section of hair, as shown in FIG. 8. The arms are released by the hinge mechanism in an upward fashion to allow the hair styling device to be removed from the hair, as shown in FIG. 9. FIG. 10 shows the device being pulled downward for removal from the person's hair. By pulling the ends of the hair strands up to the head it forms an elongated twisted knot self secured with no pins or bands.

The body of the hair styling device 112 is wide at the top, tapering down to 114 a point in which to part the hair easily. The two arms 116*a* and 116*b* are connected to a hinge 118 to allow the arms 116*a* and 116*b* to be released upward. A section of hair is divided into two separate sections by the body 112. One of the strands of the divided hair is then crossed over the body 112 and placed under the opposite arm, 116*a* or 116*b*, and up through the open space provided, when body 112 is inserted through a section of hair. The end is then wrapped twice around the strand of hair. The other strand is then crossed over body 112 and placed under the other arm 116 and down through the open space provided by body 112, then wrapped twice around the strand of hair. By holding the ends of the wrapped sections of hair in front of body 112 you are then able to pull the hair styling device from the hair, as the arms are released from hinges 118 allowing the hair styling device to be removed. When removed, by pulling the ends of the ends of the section of wrapped hair to the head it then forms a twisted elongated knot, self secured with no pins or bands.

While the present disclosure has been made with reference to the foregoing preferred embodiments, those skilled in the art will understand that many variations may be made therein without departing from the spirit and scope defined in the following claims. The disclosure should be understood to include all novel and non-obvious combinations of elements described herein, and claims may be presented in this or a later application to any novel and non-obvious combination of these elements.

What is claimed is:

1. A method of styling hair comprising:

separating a section of hair;

dividing the section of hair into two strands of hair using a hair styling device with each strand positioned between a body of the device and an arm of the device;

crossing each of the two strands over the front of the body of the hair styling device and sliding each strand under an arm opposed to the arm bounding each strand;

pulling each strand up through a space between the body of the styling device and the scalp;

wrapping each strand a plurality of times around a section of the opposite strand located between the body of the device and the scalp;

extending each section of hair around the outside of the arm defining the bounds of the opposite section; and removing the hair styling device using a downward motion causing the arms to pivot upward pulling permitting the hair wrapped around them to be released and securing the hair into a twisted knot.

* * * * *